United States Patent [19]

Ganz

[11] Patent Number: 4,749,123

[45] Date of Patent: Jun. 7, 1988

[54] VARIABLE PLANE COMPRESSION APPARATUS, METHOD OF UTILIZING SAME, AND CARTON FOR USE THEREWITH

[75] Inventor: Robert H. Ganz, Saddle River, N.J.

[73] Assignee: Federal Paper Board Co., Inc., Montvale, N.J.

[21] Appl. No.: 2,995

[22] Filed: Jan. 13, 1987

Related U.S. Application Data

[62] Division of Ser. No. 716,492, Mar. 27, 1985, Pat. No. 4,651,502.

[51] Int. Cl.[4] ..... B65D 25/22

[52] U.S. Cl. ..... 229/40; 206/140; 206/427; 229/900

[58] Field of Search ..... 229/900, 48 R, 40; 206/427, 434, 140, 147-149, 151-161

[56] References Cited

U.S. PATENT DOCUMENTS

| | | | |
|---|---|---|---|
| 3,341,908 | 9/1967 | Lock | 229/48 R |
| 3,373,867 | 3/1968 | Wood | 206/140 |
| 3,556,386 | 1/1971 | Ganz | 229/40 |
| 3,570,746 | 3/1971 | Wood | 206/140 |
| 3,850,292 | 11/1974 | Manizza et al. | 206/140 |
| 4,373,630 | 2/1983 | Oliff | 229/40 |

FOREIGN PATENT DOCUMENTS

| | | | |
|---|---|---|---|
| 302740 | 7/1968 | Sweden | 229/40 |

*Primary Examiner*—George E. Lowrance
*Assistant Examiner*—Gary E. Elkins
*Attorney, Agent, or Firm*—Charles A. Brown; Charles E. Brown

[57] ABSTRACT

This relates to providing internal compression in packages of the type utilizing a wrap around carton. Instead of utilizing locking cut outs provided for receiving articles to be packaged, special compression cuts are formed in the closure panels of a wrap around carton so that the compression cuts are independent of the locking cut outs thereby permitting one chain and lug arrangement to be utilized in conjunction with numerous types of packages. The lugs are carried by compression chains located in a plane below the support plane of the articles to be packaged with the lugs being pivotally mounted on pins and normally having downwardly sloping positions for engaging in the compression cuts when the closure flaps are in their generally vertical depending position. The lugs are swingable upwardly to generally horizontal positions with the closure panels. Each lug carries a finger having a nose particularly configurated for automatically entering and centering within a compression cut.

2 Claims, 2 Drawing Sheets

FLOW

VARIABLE PLANE COMPRESSION APPARATUS, METHOD OF UTILIZING SAME, AND CARTON FOR USE THEREWITH

This is a division of application Ser. No. 716,492 filed Mar. 27, 1985, now U.S. Pat. No. 4,651,502, issued Mar. 24, 1987.

This invention relates in general to new and useful improvements in the formation of packages wherein cartons of the wrap around type have side panels pulled tightly around the articles being packaged with the tightened side panels being held in that state while the closure panels of the carton are folded into position and secured relative to one another. Most particularly, this invention relates to an apparatus which is an improvement on the apparatus disclosed and claimed in my prior U.S. Pat. No. 3,474,590 and an improved carton of the type disclosed in my prior U.S. Pat. No. 3,556,386.

The major advantage of the compression system of this invention is that it greatly simplifies and shortens the changeover time when going from one pack size or grouping to another. Presently, the internal compression system provides a tightening lug for each container in a package. The tightening lugs are carried by chains which must be replaced or the individual lugs moved with respect to the chains when changing the apparatus from one container grouping or one container diameter to a different one. This operation is the most time-consuming part of an entire changeover.

In accordance with this invention, the tightening lugs are disassociated from the individual containers which, first of all, permits the use of fewer lugs. By placing the individual cut outs on the closure panels in positions remotely located from the individual containers, a common compression cut out location may be used in conjunction with cartons or wraps covering a range of different sizes and groupings. As a result, when utilizing the present apparatus, no compression changeover is required other than moving the compression chains closer or farther apart to accommodate different container sizes. This operation can be easily calibrated and automated for greatly simplified changeover procedure accomplished in less than half the present time.

With the above and other objects in view that will hereinafter appear, the nature of the invention will be more clearly understood by reference to the following detailed description, the appended claims, and the several views illustrated in the accompanying drawings.

Figure 3:
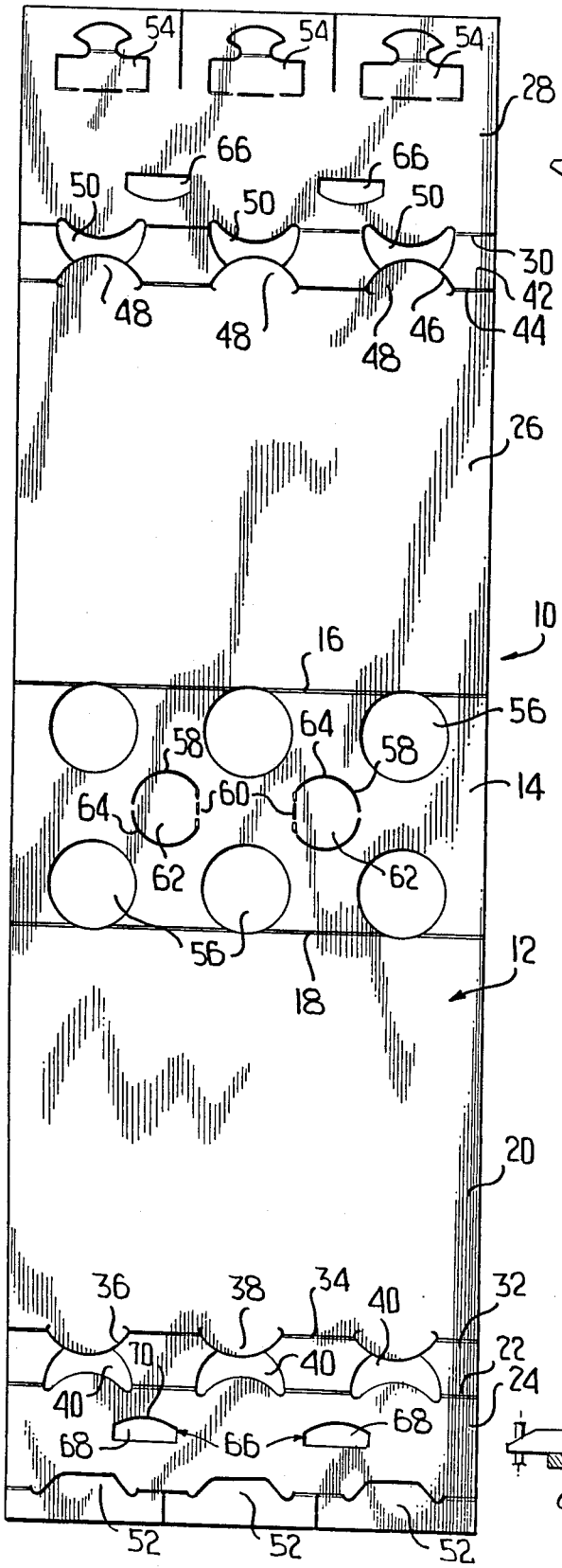
FIG. 3 is a plan view of a blank for forming a carton in accordance with this invention.

Referring now to the drawings in detail, reference is first made to FIG. 3 wherein there is illustrated a carton blank for a carton formed in accordance with this invention, the carton blank being generally identified by the numeral 10. The carton blank 10 is in the form of an elongated, generally rectangular, strip of paperboard with the strip being generally identified by the numeral 12. The strip 12 has a central portion in the form of a top panel 14 which is set out from the remainder of the strip 12 by a pair of transverse fold lines 16, 18. A first side panel 20 is joined to the top panel 14 along the fold line 18 and, in turn, has connected thereto along a transverse fold line 22 an inner closure panel 24.

A second side panel 26 is connected to the top panel 14 along the fold line 16 and in turn carries an outer closure panel 28 which is connected thereto along a transverse fold line 30.

The side panel 20 has a lower panel portion 32 which extends between the fold line 22 and a fold line 34 with the fold line 34 being interrupted by part circular cuts 36 defining flaps 38. The flaps 38 are centered on the containers which are to be packaged within the carton formed by the blank 10. In alignment with each of the flaps 38 is a locking cut out 40 which extends partially across the fold line 22 into the closure panel 24. The base of each of the containers or like article which is to be packaged within the resultant carton projects through and is locked within the cut out 40.

The side panel 26 has a like lower portion 42 which extends between the fold line 30 and a transverse fold line 44 which is interrupted by a second set of arcuate cut lines 46 defining flaps 48. A further locking cut out 50 is aligned with each of the flaps 48 for receiving the base of a container. The cut outs 50 extend across the fold line 30 into the closure panel 28.

The closure panel 24 is considered to be the primary locking panel and carries primary locks 52. On the other hand, the closure panel 28 may be considered to be a male locking panel and carries male locks 54.

The top panel 14 may be provided with suitable openings 56 for receiving necks of bottles. Further, there are provided combinations of cut lines 58 and fold lines 60 defining tabs 62 which, when pushed into the interior of the resultant carton, define finger receiving openings 64.

The carton blank 10, as described, is in accordance with my U.S. Pat. No. 3,556,386 and as such is known. The carton blank 10 and the carton formed therefrom is improved in accordance with this invention by the provision in the panels 24 and 28 of compression cut outs 66. Each compression cut out 66 includes a generally rectangular base portion 68 which is generally parallel to the respective one of the fold lines 22, 30 and is remote therefrom. Each compression cut out 66 also includes a portion defined by an arcuate cut line 70 so as to have a domed appearance. The arcuate cut line 70 generally faces the respective one of the fold lines 22, 30.

It is to be understood that the compression cut outs 66 may be positioned as desired in the width direction of the panels 24, 28 with the positions of the compression cut outs 66 being in no way dependent upon the positions of the locking cut outs 50 and the intended position of articles or containers within the resultant carton.

Having described the carton improvement in accordance with this invention, reference is now made to FIGS. 1, 2 and 4–7 which show generally the details of a package forming apparatus having associated therewith the compression apparatus which is a feature of the invention. In a known manner, when packaging bottles, for example, arranged in columns and rows, such bottles or like containers are arranged in groups which in the illustrated embodiment of the invention contains six containers. The carton blank 10 will be placed into overlying relation to each group of containers and in the case of containers having necks and closures, the necks and closures will pass through the openings 56. Thereafter, the side panels 20, 26 will be plowed down to extend down along side the group of containers in the manner generally shown at the right in FIG. 2. At this time the closure panels 24, 28 will depend down as continuations of the side panels 20, 26.

Figure 4:
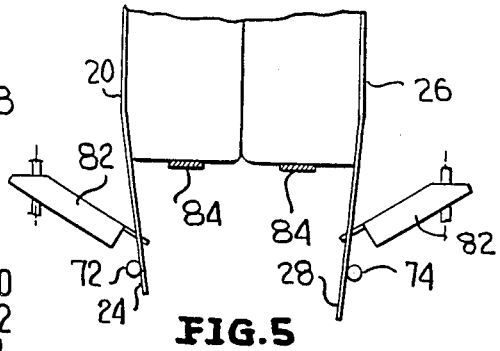
FIG. 4 is a schematic transverse vertical sectional view taken generally along the line 4—4 of FIG. 1 and shows the fingers of the compression lugs initially engaging in compression cut outs in closure panels of a carton.
Figure 5:
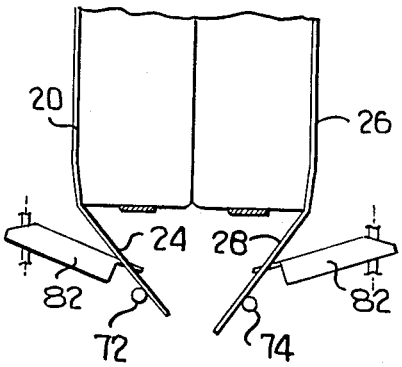
FIG. 5 is a fragmentary vertical sectional view taken generally along the line 5—5 of FIG. 1 and shows the compression lugs as they move together with the fingers thereof engaged in the closure panels as they fold upwardly beneath the containers.

In the absence of the tightening of the carton with respect to the containers, in a conventional manner utilizing suitable plowers or the like identified by the reference numerals 72, 74 in FIGS. 4 and 5, the closure panels 24 and 28 will be folded up beneath the group of containers with the closure panel 24 being advanced ahead of the closure panel 26. As the closure panels 24, 26 approach their horizontal positions of FIG. 6, the primary locks 52 and the male locks 54 will be sequentially engaged so as to lock together the closure panels 24, 26. The details of this are not illustrated in that it in of itself does not form part of this invention.

Figure 1:
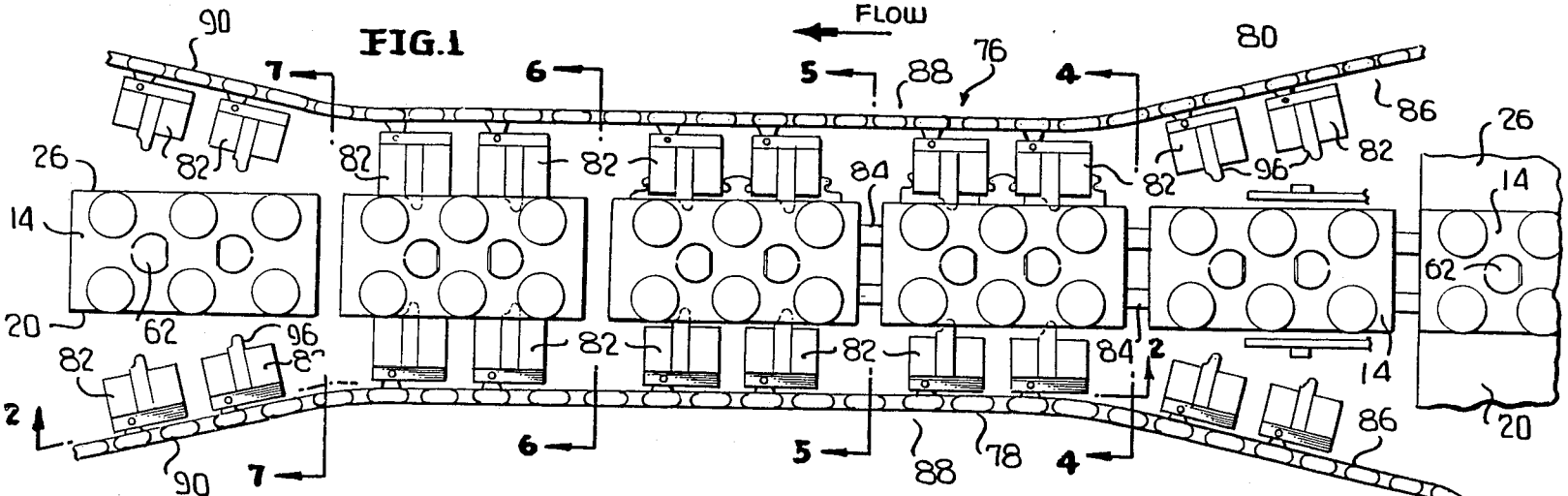
FIG. 1 is a plan view of an apparatus for applying cartons to a plurality of articles, such as containers, to form packages and incorporates the compression apparatus of this invention.
Figure 6:
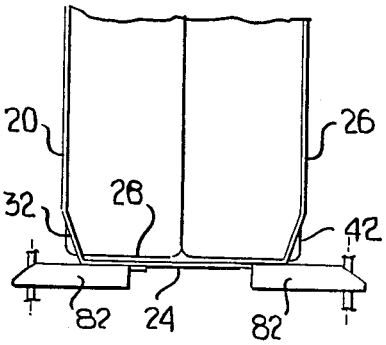
FIG. 6 is a fragmentary sectional view taken generally along the line 6—6 of FIG. 1 and shows the closure panels in their fully closed positions and lower portions of the side panels drawn tightly together about the containers.

In accordance with this invention it is desired that the lower portions of the side panels 20, 22 be drawn tight around the containers with the panel portions 32, 42 being tightly drawn around the base portions of the containers in the manner shown in FIG. 6 so as to interlock the containers with the side panels 20, 26. To this end there is provided the compression cut outs 66 and a variable plane compression apparatus generally identified by the numeral 76. The apparatus 76 includes a pair of chains 78, 80 which carry at regularly spaced intervals sets of lugs 82 as is best shown in FIG. 1. The chains 78, 80 lie in a common plane below the plane of supports for the containers, which supports are illustrated as flat strips 84 in FIGS. 4 and 5. The chains 78, 80 are continuous and pass about a predetermined path. The path of the chains 78, 80 include a first converging portion 86 wherein the chains 78, 80 rapidly move together. This is followed by a second converging portion 88 wherein the chains 78, 80 slope only slightly with respect to the path of movement of the group of containers. It is along this portion of the path that the closure panels 24, 28 are drawn together so as to draw the panel portions 32, 42 tightly about the containers which are being packaged.

The path of the chains 78, 80 include diverging portions 90 where the chains move away from the formed containers.

Figure 8:
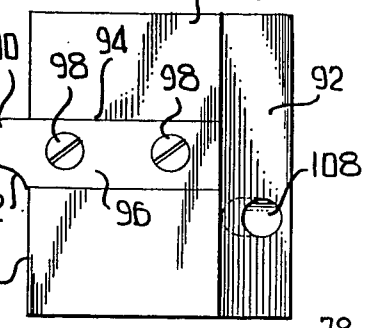
FIG. 8 is an enlarged plan view of a typical compression lug and the finger carried thereby.
Figure 9:
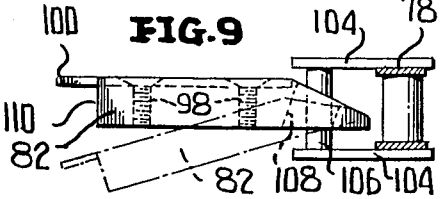
FIG. 9 is an enlarged sectional view taken through one of the conveyor chains for the lugs and shows the mounting of a typical lug on a barrel pin carried by the associated carrier chain.
Figure 2:
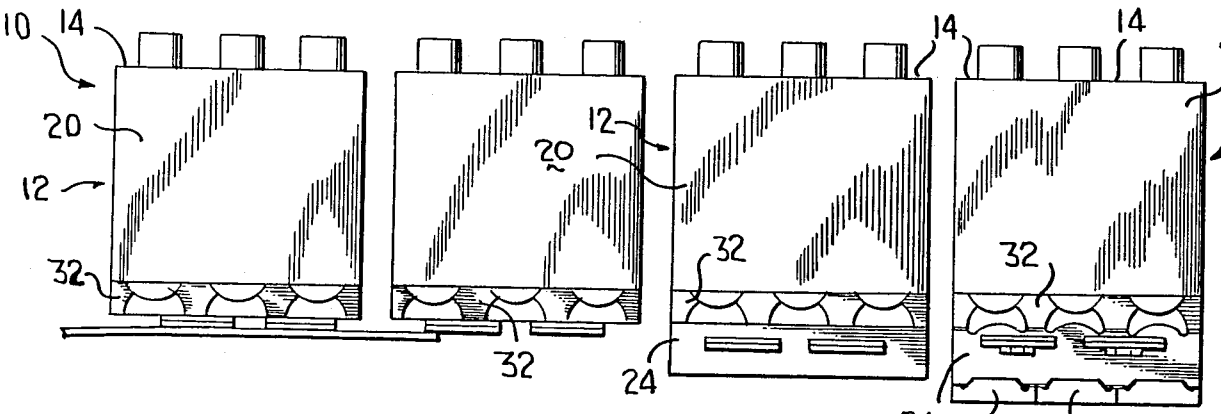
FIG. 2 is a fragmentary vertical sectional view taken generally along the line 2—2 of FIG. 1 and shows further the details of the compression apparatus in relation to the cartons.

Reference is now made to FIGS. 8 and 9 wherein there is illustrated a typical lug 82. Each lug 82 is of a rectangular outline and is formed of a thick plate. One edge of the lug 82 is bevelled as at 92 while the remainder of the lug is of a uniform thickness except for having a groove 94 in which there is seated a major portion of a finger 96. The finger 96 is secured to the lug 82 by a pair of screws 98 having countersunk heads.

It will be seen that each finger 96 projects beyond the lug 82 and has a rounded nose 100 which is offset to one side of the center of the finger 96 so as to facilitate entry of the finger 96 into a respective compression cut out 66. At the opposite edge of the finger 96, the projecting part of the finger is provided with an arcuate guide portion 102 which serves to center the projecting nose of the finger in the respective compression cutout 66.

Each of the carrier chains 78, 80 carries at intervals support bars 104 which have extending therebetween a barrel pin 106 which is vertically disposed. The barrel pin 106 extends through a larger diameter bore 108 in the bevelled portion 92 of the lug 82 as is clearly shown in FIGS. 8 and 9. The bore 108 is at an angle to the horizontal as is clearly shown in FIGS. 8 and 9. This permits the lug 82 to assume an operative horizontal position, as shown in solid lines in FIG. 9, while permitting the lug 82 to drop or pivot to a downwardly sloping tilted position as shown in phantom lines in FIG. 9. It is to be understood that the downward tilting of the lug 82 is restricted by the walls of the bore 108 engaging the pin 106.

It is also pointed out at this time that the fingers 96 of the lugs of each set of lugs are spaced in accordance with the spacing of the compression cut outs 66 in a respective closure panel of the carton to be applied. As will be described hereinafter, the compression cut outs will be uniformly spaced in all cartons which are to be applied to a group of articles to form packages in accordance with this invention.

Referring now to FIG. 4, it will be seen that as the lugs 82 converging, the noses 100 of the fingers 96 will be at elevations to be received in the compression cut outs 66. Then as the lugs 82 pass along the path of the apparatus together with the articles being packaged and the cartons, the lugs will move further together in a gradual manner while the closure panels 24, 26 are folded up beneath the articles being packaged. The fingers 96 having been engaged within the compression cut outs 66, will effect an upward pivoting of the lugs 82 until the lugs assume horizontal positions as is best shown in FIG. 6. At this time the lugs 82 have drawn the closure panels 24 into a maximum overlapped relation with the result that the panel portions 32, 42 of the side panels 20, 26 are drawn around the base portions of the articles being packaged and interlocked therewith in the manner shown in FIG. 6.

It is to be understood that by having the fingers 96 recessed in the upper surfaces of the lugs 82, an edge 110 of each lug 82 remote from the bevelled portion 92 thereof may function as a stop surface limiting the projection of each finger 96 into the respective compression cut out 66 with the surface 110 then effectively forming the means for drawing the closure panels 24 and 26 together and effecting compression of the articles being packaged within the side panels 20, 26 in the manner shown in FIG. 6.

Figure 7:
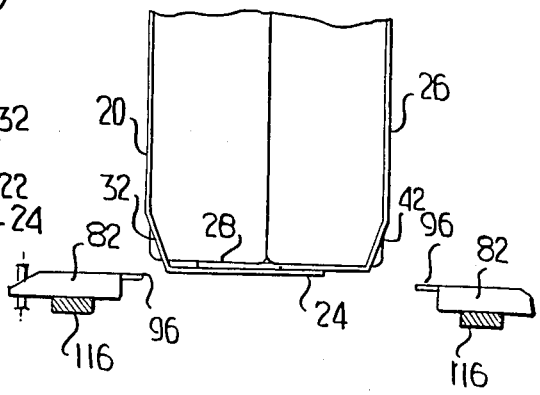
FIG. 7 is a fragmentary sectional view taken generally along the line 7—7 of FIG. 1 and shows the completely closed carton and the manner in which the compression lugs are supported as they are laterally withdrawn relative to the package.

After the package has been formed, it is necessary to withdraw the lugs 82 and the fingers 96. In order to assure movement of the lugs 82 in a horizontal plane, support bars 116 are provided. These support bars, as is shown in FIG. 7, underlie the lugs 82. After these lugs 82 reach the position shown in FIG. 7, the support bars 116 are discontinued and the lugs 82 are free to pivot relative to the pins 106 and drop to their tilted dotted line position of FIG. 9 for passage around the path of the chains 78, 80 for engagement at a later time with another carton blank in the same manner as described hereinabove.

Inasmuch as the compression lugs engage in the separately formed compression cut outs 66, it will be apparent that by utilizing a common compression cut out location cartons or wraps covering a ranch of different sizes of articles or containers as well as a different range of groupings, may be operated on by merely moving the compression chains closer or farther apart to accommodate diameter differences. Even this operation can be easily calibrated and automated for greatly simplified changeover procedure which can be accomplished in less than half the time of the prior arrangement.

Although only a preferred embodiment of the compression system and the carton blank arrangement has been specifically illustrated and described herein, it should be understood that minor variations may be made therein without departing from the spirit and scope of the invention as defined by the appended claims.

I claim:

1. A carton of the wrap around type comprising among other panels a pair of side panels and a closure panel carried by each of said side panels for closing the carton about a plurality of containers to be packaged therein, the carton being improved by at least one compression cutout in each of said closure panels for receiving a tightening lug to tension each of said closure panels and thereby draw together and tighten said side panels relative to containers being packaged, each of said closure panels being joined to a respective one of said side panels along a fold line, and each of said compression cutouts being spaced from a respective one of said fold lines and having a generally rectangular base portion disposed parallel to and remote from a respective one of said fold lines, said generally rectangular base portion opening towards said respective one of said fold lines, and there being an arcuate top portion opening away from said respective one of said fold lines.

2. A carton of the wrap around type comprising among other panels a pair of side panels and a closure panel carried by each of said side panels for closing the carton about a plurality of containers to be packaged therein, the carton being improved by at least one compression cut in each of said closure panels for receiving a tightening lug to tension each of said closure panels and thereby draw together and tighten said side panels relative to containers being packaged, each of said side panels having a lower locking panel portion having locking cuts therein for receiving bases of containers to be packaged in said carton, and the positions of said compression cuts being independent of and out of transverse alignment with intended positions of containers in said carton and the related positions of said locking cuts.

* * * * *